US005695227A

United States Patent [19]

Smallegan et al.

[11] Patent Number: 5,695,227

[45] Date of Patent: Dec. 9, 1997

[54] LOCK PLATFORM

[75] Inventors: Jon M. Smallegan; L. C. Derek Chamberlain; Dario Pompeii, all of Colorado Springs, Colo.

[73] Assignee: Schlage Lock Company, San Francisco, Calif.

[21] Appl. No.: 712,250

[22] Filed: Sep. 11, 1996

Related U.S. Application Data

[63] Continuation of Ser. No. 364,865, Dec. 27, 1994, abandoned.

[51] Int. Cl.[6] ..... E05B 3/00

[52] U.S. Cl. ..... 292/336.3; 292/140; 292/244

[58] Field of Search ..... 292/140, 143, 292/244, 336.3, 145, 165, 170

[56] References Cited

U.S. PATENT DOCUMENTS

| | | | |
|---|---|---|---|
| 452,738 | 5/1891 | Van Winkle | 70/467 |
| 553,444 | 1/1896 | Wilson | 70/210 |
| 1,254,194 | 1/1918 | Le Beau | 70/451 |
| 1,309,438 | 7/1919 | Keefer | 70/210 |
| 2,303,790 | 12/1942 | Chesler | 70/451 |
| 2,917,915 | 12/1959 | Rainman | 70/210 |
| 3,990,277 | 11/1976 | Mullich | 70/107 |
| 4,183,563 | 1/1980 | Stevens | 70/107 |
| 4,276,760 | 7/1981 | Nolin | 70/107 |
| 4,572,556 | 2/1986 | Foshee | 70/467 |
| 4,979,767 | 12/1990 | Lin | 292/336.3 |
| 4,982,986 | 1/1991 | Gressett, Jr. et al. | 292/336.3 |
| 5,149,155 | 9/1992 | Caeti et al. | 292/336.3 |

*Primary Examiner*—Rodney M. Lindsey
*Assistant Examiner*—Tuyet-Phuong Pham
*Attorney, Agent, or Firm*—Robert F. Palermo; Michael H. Minns

[57] ABSTRACT

A lock platform for a door includes a face plate lying in a vertical plane parallel to the plane of the door and an outer peripheral edge margin which extends from the outer periphery of the face plate generally perpendicularly away from the face plate and towards the door when mounting the lock platform on the door. The edge margin engages the door in such a manner that the face plate is spaced from the door thereby creating a space between the face plate and the door for accommodating components of a handle and lock assembly. The lock platform further includes an outwardly facing hollow boss located on the face plate and spaced from the hole of the door when mounting the lock platform thereon. The boss defines a first opening for receiving a handle of the handle and lock assembly or the like therein. The lock platform also includes a second opening for receiving a key cylinder, thumb turn member or the like therein. The second opening extends generally co-axial with respect to the hole of the door wherein when a key cylinder is mounted on the lock platform within the opening, the key cylinder extends into the hole of the door. Screw fasteners mount the face plate of the lock platform to a face plate of a second lock platform of similar construction positioned oppositely with respect to the lock platform on the other side of the door.

6 Claims, 4 Drawing Sheets

LOCK PLATFORM

This application is a continuation of application Ser. No. 08/364,865, filed Dec. 27, 1994 now abandoned.

BACKGROUND OF THE INVENTION

This invention generally relates to door hardware and more particularly to door hardware including at least one lock platform which separates the axis of rotation of a handle from the axis of rotation of a lock.

The construction industry has standardized commercial and retail door configurations wherein a conventional door preparation consists of a 2⅛ inches in diameter bored hole through the door at a standard backset of 2⅜ inches or 2¾ inches and an intersecting ⅞ inch or 1inch in diameter bored hole from an edge of the door. The larger hole extends from one planar surface of the door, through the door and to an oppositely facing planar surface of the door. The smaller cross-hole extends from the edge of the door adjacent to the hole in a cross-wise direction with respect to the larger hole and is in communication with the larger hole. A pair of lock platforms are adapted to mount on opposite sides of the larger hole in a position where the lock platforms cover the hole and house the various components of a door handle and lock assembly. The lock platforms also function to protect the components of the handle and lock and to prohibit tampering therewith.

Current usage in commercial and retail cylindrical and tubular lock applications has an opening centerline for a lock platform of a door handle assembly as the main axis for mounting and rotation of a handle (e.g., a knob or lever) of the assembly and as the axis of action for a key cylinder of the assembly. This construction typically requires the key cylinder to be located in the handle. The result of having the key cylinder mounted within the handle is a degraded performance of the handle in terms of bearing support. Thus, security of the lock is limited to the strength of retention of the handle and its attachment to the lock platform.

With the recent emergence of handicap codes for commercial buildings which specify levers as handles and an increasing desire for a higher level of security with door locks, it has been found that traditional door lock designs do not provide a secure or stable lock platform on which to mount the door handle and the door handle operating mechanism and lock.

The foregoing illustrates limitations known to exist in present lock platforms. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a lock platform for a door comprising a face plate lying in a vertical plane parallel to the plane of the door and an outer peripheral edge margin which extends from the outer periphery of the face plate generally perpendicularly away from the face plate and towards the door when mounting the lock platform on the door. The edge margin engages the door in such a manner that the face plate is spaced from the door thereby creating a space between the face plate and the door for accommodating components of a handle and lock assembly. The lock platform further includes an outwardly facing hollow boss located on the face plate and spaced from the hole of the door when mounting the lock platform thereon. The boss defines a first opening for receiving a handle of the handle and lock assembly therein. The lock platform also includes a second opening for receiving a key cylinder, thumb turn member or the like therein. The second opening extends generally co-axial with respect to the hole of the door wherein when a key cylinder is mounted on the lock platform within the opening, the key cylinder extends into the hole of the door. Means mounts the face plate of the lock platform to a face plate of a second lock platform of similar construction positioned oppositely with respect to the lock platform on the other side of the door. The mounting means draws the face plates of the lock platforms towards each other when securing the lock platforms to the door.

In another aspect of the present invention a door handle and lock assembly for a door comprises an outside lock platform and an inside lock platform, each being constructed in accordance with the lock platform of the present invention. The assembly further comprises an outside handle mounted on the face plate of the outside lock platform within its first opening and rotatable about a first axis. A key cylinder is mounted on the face plate of the outside lock platform within the second opening and rotatable about a second axis which is separate from the first axis. The key cylinder extends from the face plate of the outside lock platform into a hole of the door. An inside handle is mounted on the face plate of the inside lock platform within its opening. Means embodying a pair of screw fasteners mounts the face plate of the outside lock platform to the face plate of the inside lock platform. When tightened the screw fasteners draw the face plates of the outside and inside lock platforms towards each other.

Accordingly, among the several objects of the present invention are the provision of an improved lock platform which can mount on an industry standard door preparation; the provision of such a lock platform which is designed to securely mount a door handle and key cylinder on a door; the provision of such a lock platform which separates the axes of rotation of the door handle and key cylinder; the provision of such a lock platform which mounts the key cylinder so that it extends into a bored hole of the door; the provision of such a lock platform which may easily accommodate left-hand or right-hand use; and the provision of such a lock platform which is simple in design and easy to assemble.

The foregoing and other aspects will become apparent from the following detailed description of the invention when considered in conjunction with the accompanying drawing figures.

BRIEF DESCRIPTION OF THE DRAWING FIGURES

In the drawings which illustrate the best mode presently contemplated for carrying out the present invention:

DETAILED DESCRIPTION

Figure 1:
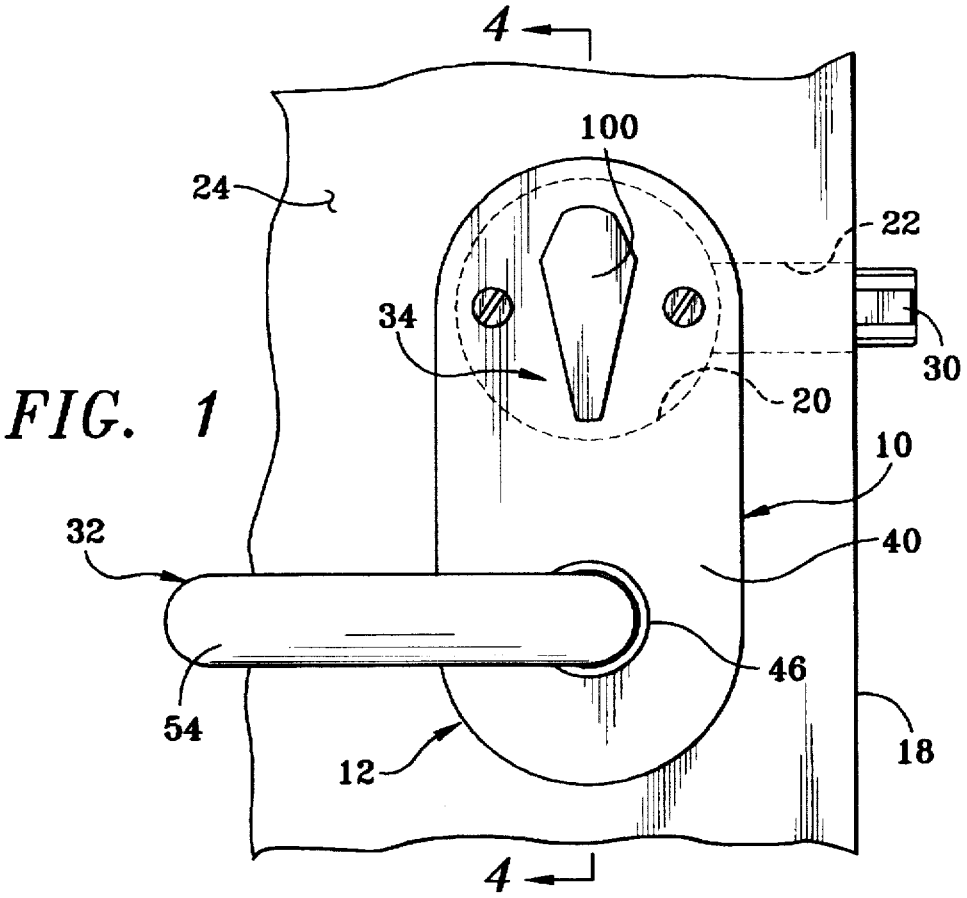
FIG. 1 is an elevational view of an inside lock platform of the present invention which is part of an inside door handle and lock assembly.
Figure 2:
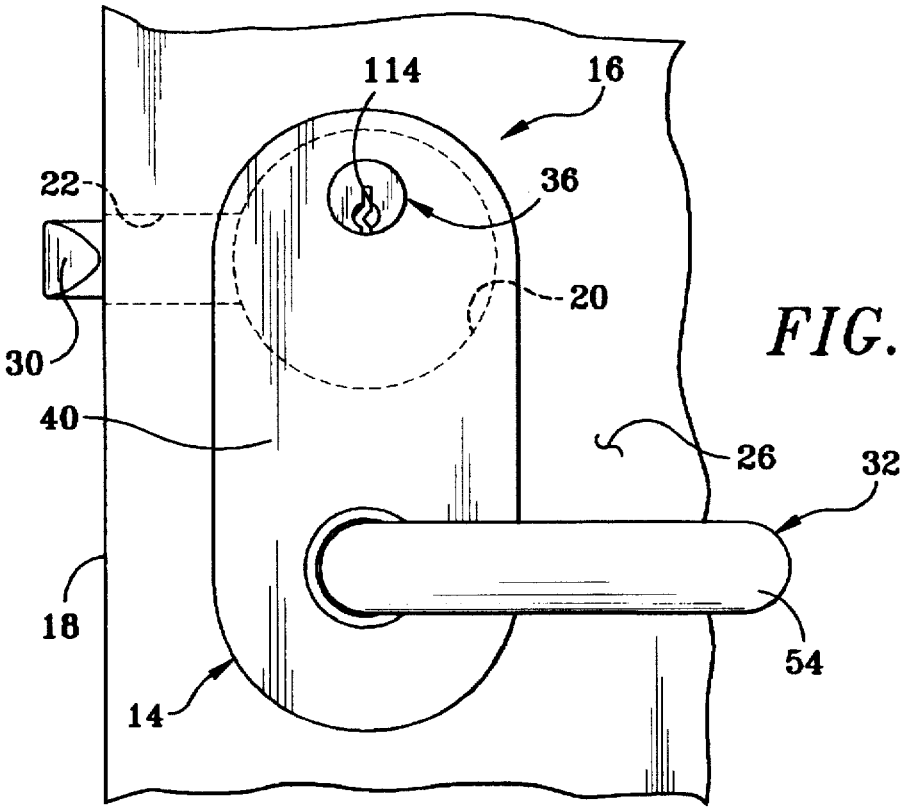
FIG. 2 is an elevational view of an outside lock platform of the present invention which is part of an outside door handle and lock assembly.
Figure 3:
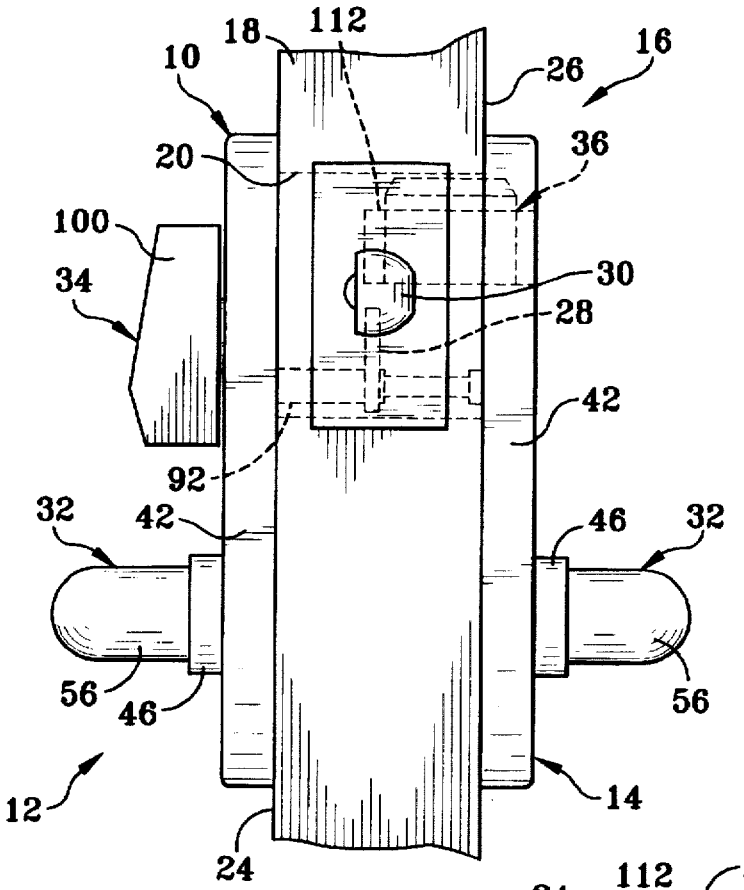
FIG. 3 is a side elevational view of the inside and outside lock platforms illustrated in FIGS. 1 and 2.
Figure 4:
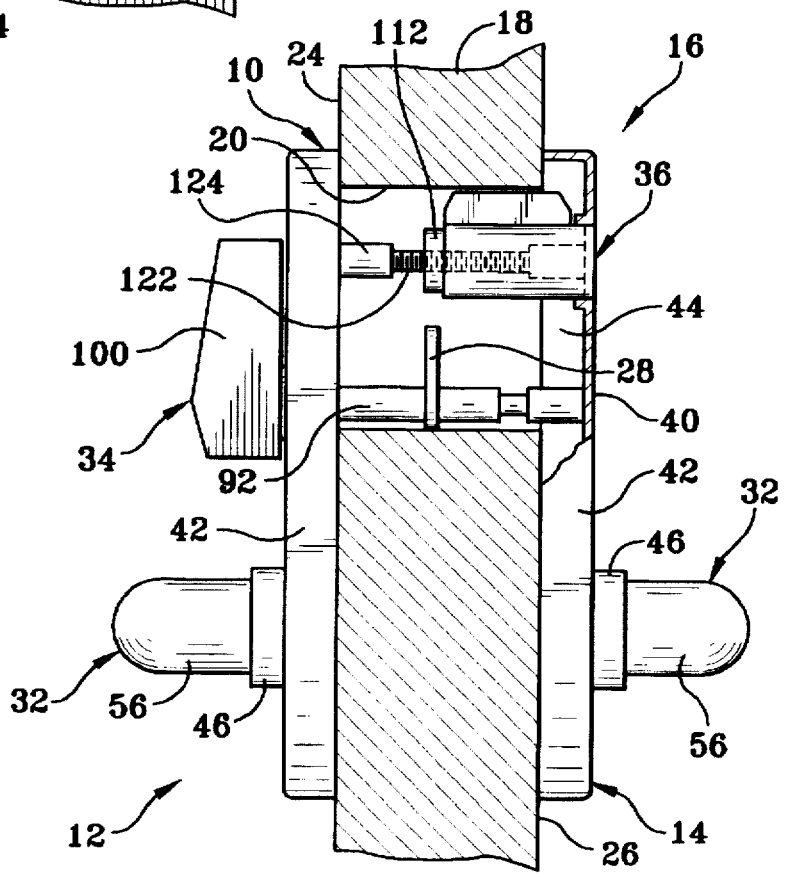
FIG. 4 is a partial cross-sectional view taken along line 4—4 in FIG. 1.

Referring now to the drawings, wherein similar reference characters designate corresponding parts throughout the several views, the embodiment of the apparatus shown in FIGS. 1 and 2 comprises an inside lock platform, generally indicated at 10, of an inside door handle and lock assembly, generally indicated at 12, and an outside lock platform, generally indicated at 14, of an outside door handle and lock assembly, generally indicated at 16, for a door 18 of conventional construction according to one embodiment of the invention. The door 18 has a standardized door preparation consisting of a 2⅛ inches in diameter bored hole 20 through the door 18 at a backset of 2⅜ inches or 2¾ inches and an intersecting ⅞ inch or 1 inch in diameter bored hole 22 from an edge of the door. The larger hole 20 extends from one planar surface 24 of the door 18, through the door 18, and to an oppositely facing planar surface 26. The smaller cross-hole 22 extends from the edge of the door 18 adjacent the hole 20 in a cross-wise direction with respect to the hole 20 and terminates at the point in which it is in communication with the hole 20. The inside and outside lock platforms 10, 14 are adapted to mount and house respective components of the inside and outside handle and lock assemblies 12, 16.

The inside and outside door handle and lock assemblies 12, 16 cooperate with one another and are especially suited for rotating a door latch arm 28 between a first position in which the door latch arm 28 actuates a bolt member 30 to extend into an opening formed in a door jamb (not shown) for locking the door 18 in a closed position and a second rotated position in which the door latch arm 28 rotates to retract the bolt member 30 out of the opening of the door jamb and into the door 18 for unlocking the door. A detailed description of a bolt latch assembly and its operation is provided in related application entitled Spring Latch with Extendable Dead Bolt, Ser. No. 08/656,736, filed Jun. 3, 1996 of which Jon M. Smallegan, L. C. Derek Chamberlain and Dario Pompeii are co-inventors.

Referring now to FIGS. 1–4, and more particularly to FIG. 1, the inside handle and lock assembly 12 includes the inside lock platform 10, a door handle, generally indicated at 32, for moving the latch arm 28 between its first and second position for enabling the door 18 to be opened, and a thumb turn member, generally indicated at 34 for locking and unlocking the door 18 from the inside. Typically, the inside handle and lock assembly 12 is mounted on the inner surface 24 of the door 18 inside the structure (e.g., a house) since means for fastening the inside lock platform to the outside lock platform is accessible on the inside lock platform, the fastening means being described in greater detail as the description of the subject invention proceeds.

Turning now to FIG. 2, the outside handle and lock assembly 16 includes the outside lock platform 14 which is constructed in a substantially identical manner to the inside lock platform 10 wherein identical reference numerals are used to indicate identical parts. The outside handle and lock assembly 16 further includes a door handle (also generally indicated at 32) which is constructed in an identical manner to the inside door handle 32 and a key cylinder, generally indicated at 36, which enables a person to unlock or lock the outside handle 32 from outside of the door 18. The key cylinder 36 is of standard construction and operates in accordance with principles well-known in the art of locks.

Figure 5:
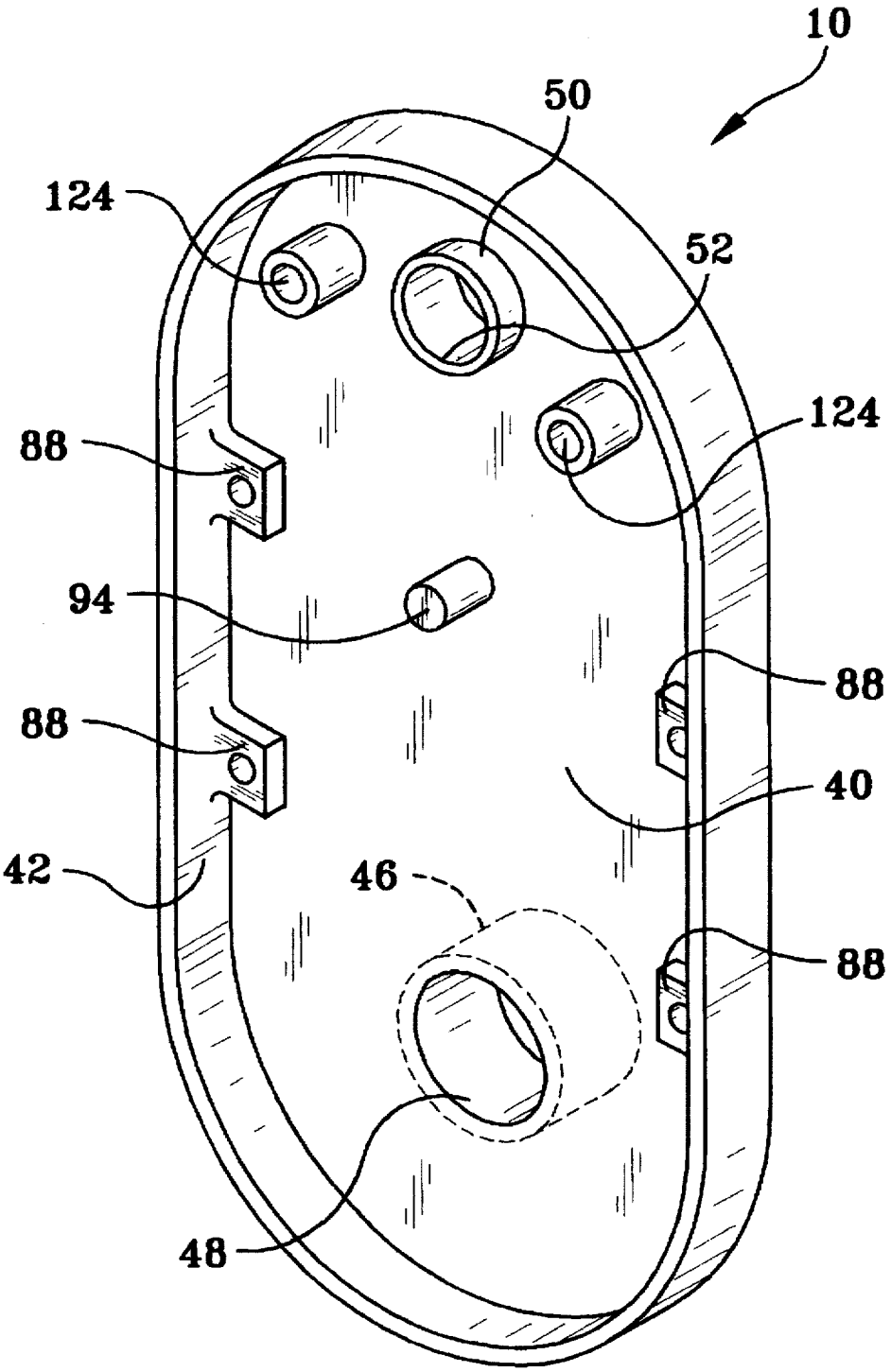
FIG. 5 is a perspective view of the inside lock platform.

Turning now to FIG. 5, which illustrates the inside lock platform 10 of the present invention, the inside lock platform 10 has an oval face plate 40 lying in a vertical plane parallel to the plane of the door 18 and an outer peripheral edge margin 42 which extends from the outer periphery of the face plate 40 generally perpendicularly away from the face plate 40 and towards the door 18 when mounting the lock platform 10 on the door 18. As illustrated, the edge margin 42 of the lock platform 10 engages the door 18 in such a manner that the face plate 40 is spaced from the door 18 thereby creating a space 44 between the face plate 40 and the door 18. This space 44 houses the various components of the handle and lock assembly 12. The inside lock platform 10 also includes an outwardly facing, circular-shaped first hollow boss 46 defining a first opening 48, and an inwardly facing, circular-shaped second hollow boss 50 defining a second opening 52, the second hollow boss 50 and second opening 52 being located above the first hollow boss 46 and first opening 48. The first and second hollow bosses 46, 50 are integral with the face plate 40, the first hollow boss 46 extending from the face plate 40 in a direction opposite to the direction of the second hollow boss 50. Preferably the lock platform 10, along with the other components of the handle and lock assembly 12, is fabricated from rigid metal, such as steel or brass. The outside lock platform 14 has a substantially identical construction as the inside lock platform 10 and any differences between them will be specifically pointed out. For both the inside and outside lock platforms 10, 14, it should be understood that the face plate 40 may embody any number of shapes (e.g., square, circular, etc.) and not just the oval shape illustrated in the drawings.

Figure 6:
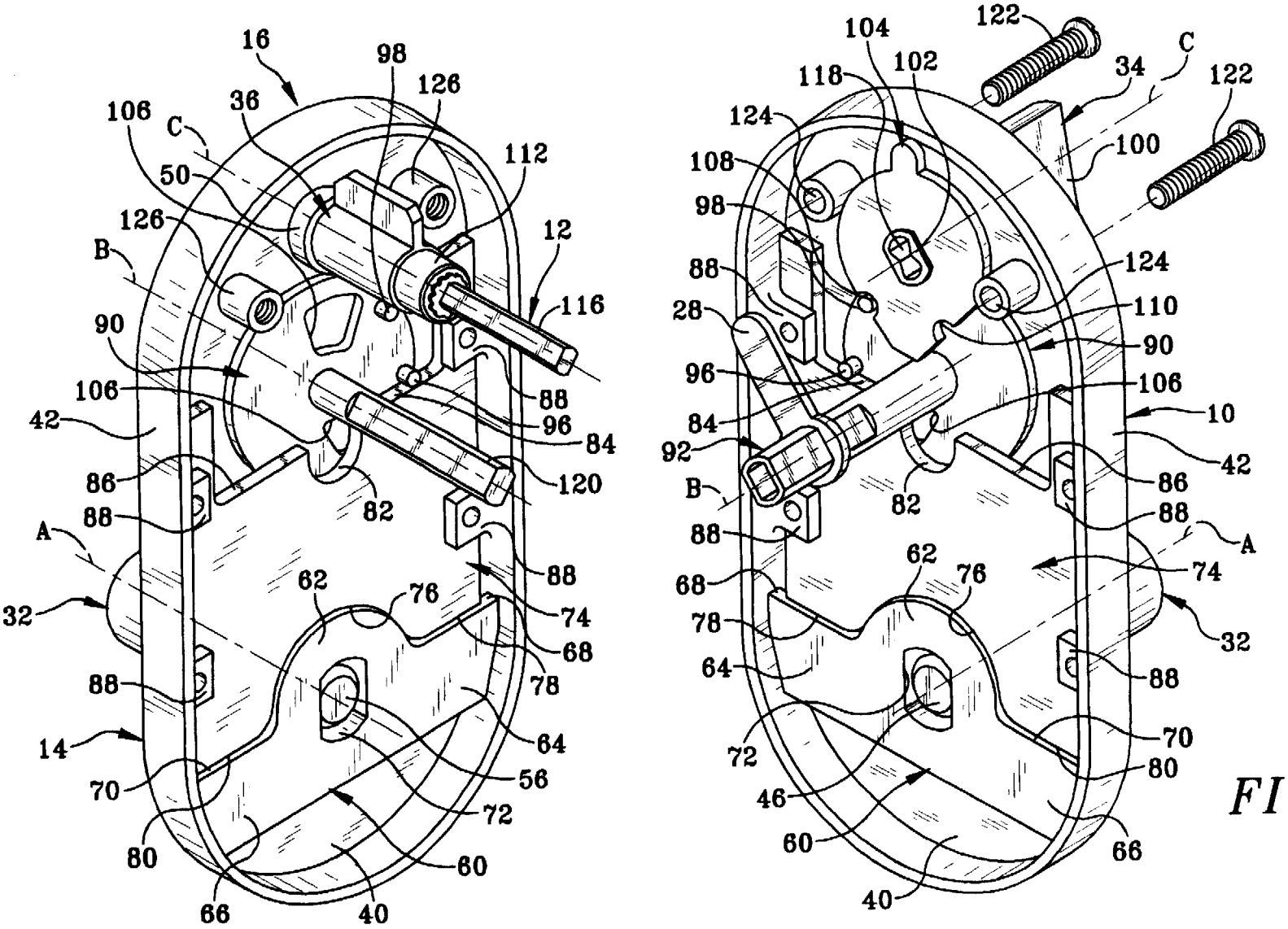
FIG. 6 is a perspective view of the inside and outside lock platforms in their pre-assembled configuration.

FIG. 6 illustrates the components of the inside and outside handle and lock assemblies 12, 16 housed by the inside and outside lock platforms 10, 14. The inside handle 32 of the inside handle and lock assembly 10 (which is depicted on the right-hand side of FIG. 6) has a lever portion 54 and a shaft portion 56, rotatable about axis A, attached at one of its ends to the lever portion 54. More specifically, the lever portion 54 extends outwardly from one side of the shaft portion 56 perpendicularly with respect to the shaft portion 56, the lever portion 54 being designed to be grasped by a person's hand for rotating the shaft portion 56. Although the lever portion 54 is illustrated in the drawings, it should be understood that any member suitable for being grasped by a person's hand, such as a door knob, for example, may be substituted for the lever portion 54. As illustrated throughout the drawings, the shaft portion 56 is received within the first opening 48 of the face plate 40 with the lever portion 54 being positioned outboard with respect to the lock platform 10 when assembling the inside handle and lock assembly 12.

Generally indicated at 60 is a driver cam having an annular housing 62 with two oppositely extending wing members 64, 66 which extend laterally outwardly from opposite sides of the housing 62, and a hollow boss (not shown) which extends from the annular housing 62 through the first opening 48 of the lock platform 10. The wing members 64, 66 include first and second upwardly facing engaging surfaces 68, 70, respectively. The purpose of the engaging surfaces 68, 70 will become apparent as the description of inside handle and lock assembly 12 proceeds.

The annular housing 62 and hollow boss of the driver cam 60 are concentrically aligned along axis A to form a continuous bore 72 which receives the shaft portion 56 of the handle 32 therein for rotating the driver cam 60 when the handle 32 is rotated. The bore 72 of the annular housing 62 and hollow boss is shaped for receiving the shaft portion 56 of the handle 32 therein so that the driver cam 60 rotates when rotating the handle 32.

The inside lock platform 10, handle 32 and driver cam 60 are interconnected with one another in such a manner that any axial movement between these components is prohibited. Reference should be made to co-pending, related application entitled Door Handle Mounting Assembly, now U.S. Pat. No. 5,476,736 of which Jon M. Smallegan, L. C. Derek Chamberlain and Dario Pompeii are co-inventors for the specific construction and assembly of these components.

Inside handle and lock assembly 12 further comprises an H-shaped link, generally indicated at 74, having a bottom edge portion and a top edge portion. The bottom edge portion includes a semi-circularly-shaped recess 76 which receives therein the annular housing 62 of the driver cam 60 and two downwardly facing first and second engaging surfaces 78, 80 which bear against respective upwardly facing engaging surfaces 68, 70 of the wing members 64, 66 of the driver cam 60 when it is in its neutral (un-rotated) position. The top edge portion includes a U-shaped recess 82 and two upwardly facing first and second engaging surfaces 84, 86. The wing members 64, 66 of the driver cam 60 move the link 74 linearly upwardly when rotating the driver cam 60. More specifically, when the handle 32 is rotated clockwise direction, the second engaging surface 70 of the second wing member 66 engages the second downwardly facing engaging surface 80 of the link 74 for moving the link 74 linearly upwardly. Similarly, when the handle 32 is rotated in a counterclockwise direction, the first engaging surface 68 of the first wing member 64 engages the first downwardly facing engaging surface 80 of the link 74 for moving it linearly upwardly with respect to the lock platform 10 in an identical fashion as when the handle 32 is rotated clockwise.

The inside lock platform 10 is provided with four guide members, each indicated at 88, which define a track for receiving the link 74 therein, the four guide members 88 guiding the link's linear up-and-down movement. Each guide member 88 is attached to and extends inwardly from the peripheral edge margin 42 of the lock platform 10 along a plane generally parallel to the plane of the face plate 40. The guide members 88 ensure that the engaging surfaces 78, 80 of the link are aligned with and engage the engaging surfaces 68, 70 of the driver cam 60.

The inside handle and lock assembly 12 also comprises a disk, generally indicated at 90, rotatably mounted on the inner surface of the face plate 40 of the inside lock platform 10 about an axis of rotation B. More specifically, the disk 90 is formed with a hollow shaft 92 which is integrally formed with the disk 90 and rotatable about axis B. The face plate 42 of the lock platform 10 further includes an inwardly facing pin or dowel 94 (FIG. 5) which is inserted into a cavity formed by the hollow shaft 92 and disk 90 which enables the disk and shaft to rotate about axis B. The recess 82 formed in the top edge portion of the link 74 receives the hollow shaft 92 when the link 74 is raised. First and second detents 96, 98 are mounted on the disk 90 and extend towards the door 18 from the disk 90. The detents 96, 98 are positioned so that each detent is spaced from the axis of rotation B and is engageable with one of the upwardly facing engaging surfaces 84, 86 of the top edge portion of the link 74 depending upon the handing of the assembly 12. The arrangement is such that the first detent 96 can be positioned to engage the first upwardly engaging surface 84 of the link 74 and the second detent 98 can be positioned to engage the second upwardly engaging surface 86 of the link 74. Thus, in the shown embodiment, when rotating the handle 32 in either a clockwise or counterclockwise direction (and thereby rotating the driver cam 60 which moves the link 74 linearly upwardly), the link 74 rotates the disk 90 clockwise. The shaft 92 receives the latch arm 28 thereon for moving the bolt member 30 to its locked and unlocked positions.

A more complete description of the latch operating assembly to include the operation of the handle 32, driver cam 60, link 74, disk 90 and shaft 92 may be found in co-pending, related application entitled Door Latch Operating Assembly, now U.S. Pat. No. 5,492,380 of which Jon M. Smallegan, L. C. Derek Chamberlain and Dario Pompeii are co-inventors.

The thumb turn member 34 of the inside handle and lock assembly 12 has a thumb turn gripper portion 100 adapted to be grasped by a person's hand for rotating the thumb turn member 34, and a thumb turn shaft portion 102 attached to the thumb turn gripper portion 100 and extending therefrom along axis C through the second opening 52 of the lock platform 10. The thumb turn member 34 is also capable of moving the latch arm 28 between its first and second positions. Specifically, a thumb turn arm, generally indicated at 104, having an opening formed therein which is shaped for receiving the thumb turn shaft portion 102 therethrough in such a manner that the thumb turn arm 104 rotates when rotating the thumb turn member 34, is selectively engageable with the disk 90 for rotating the disk 90 when the thumb turn member 34 is rotated. The thumb turn arm 104 has an outwardly projecting protrusion (not shown) which is received through one of two openings each indicated at 106 formed in the disk 90 for engaging the disk 90. The arrangement is such that, when rotating the thumb turn member 34 counterclockwise, the protrusion of the thumb turn arm 104 selectively engages the disk 90 for rotating the disk 90 as illustrated in the drawings and thereby rotating the latch arm 28 between its first and second positions. The second opening 106 is provided for when the second detent 98 is engaging the second upwardly engaging surface 86 of the link 74. A more complete description of the thumb turn member 34 and thumb turn arm 104 and their operation is provided in the above-referenced now U.S. Pat. No. 5,492,380.

In a preferred embodiment, the second detent 98 of the disk 90 is received in the first of two notches 108, 110 formed along opposite sides of the thumb turn arm 104. It should be understood that when the second detent 98 is engaging the second upwardly engaging surface 86 of the link 74, the first detent 96 is received within the second notch 110. The arrangement is such that upon movement of the link 74 upwardly, the second detent 98 rotates the thumb turn arm 104 which in turn rotates the thumb turn member 34.

As mentioned briefly above, the inside handle and lock assembly 12 works in cooperation with the outside handle and lock assembly 16 which is illustrated on the left-hand side of FIG. 6. The outside handle and lock assembly 16 is nearly identical in construction to the inside handle and lock assembly 12 except for the provision of the key cylinder 36 in lieu of the thumb turn member 34 and thumb turn arm 104. Thus, parts of identical construction are referenced with the same reference numbers. As illustrated in FIG. 6, the key cylinder 36 includes a cylindrical body 112 mounted in a suitable manner within the second opening 52 of the outside lock platform 14 and extends along axis C. It should be observed in FIGS. 3 and 4 that the body 112 of the key cylinder 36 extends into the hole 20 of the door 18. This extension of the key cylinder 36 into the hole 20 increases the overall security of the door 18 in that only the end of the key cylinder 36 having a keyhole 114 is exposed. Thus, since the length of the key cylinder 36 is positioned within the lock platform 14 and hole 20, it is somewhat tamper resistant.

A rod 116 is mounted on the end of the body 112 of the key cylinder 36 and is coaxial therewith along axis C. The rod 116 extends into an axial opening 118 formed in the shaft portion 102 of the thumb turn member 34 and is shaped for being received within the opening 118 so that the rod 116 rotates when rotating the thumb turn member 34 and visa versa. The keyhole 114 of the key cylinder 36 is adapted to receive a key (not shown) in the conventional manner for allowing the rotation of the rod 116 when it is desired to unlock the door 18 and for prohibiting the rotation of the rod 116 when it is desired to lock the door 18.

As illustrated in FIG. 6, the disk 90 of the outside handle and lock assembly 16 includes a shaft 120 which is received within and rotatable with the hollow shaft 92 of the disk 90 of the inside handle and lock assembly 12. Thus, when the key cylinder 36 is unlocked and the rod 116 is free to rotate, the outside lever portion 54 of the outside handle 32 can rotate the latch arm 28 between its first and second positions in a manner identical to the operation of the inside handle and lock assembly 12.

As mentioned above, means, embodying a pair of screw fasteners, each indicated at 122, secure the inside handle and lock assembly 12 to the outside handle and lock assembly 16. As shown in FIG. 6, the inside lock platform 10 has a pair of spaced-apart openings 124 defined by inwardly projecting bosses which receive the screw fasteners 122 therethrough. For home use, it is preferable to mount the inside platform 10 interiorly within the house rather than exteriorly for preventing tampering with the handle and lock assembly. The outside lock platform 14 has a pair of inwardly extending, internally threaded bosses 126 which are mounted on the inner surface of the face plate 40. The bosses 126 are located on the inner surface of the face plate 40 of the outside lock platform 14 to correspond to the location of the openings 124 of the inside lock platform 10. As shown, in order to assemble the inside and outside handle and lock assemblies 12, 16, the rod 116 of the key cylinder 36 is received in the opening 118 of the shaft portion 102 of the thumb turn member 34, the shaft 120 of the disk 90 of the outside assembly 16 is received in the hollow shaft 92 of the disk 90 of the inside assembly 12 and the edge margins 42 of the inside and outside lock platforms 10, 14 are engaging the inner and outer surfaces 24, 26 of the door 18, respectively. Next, the screw fasteners 122 may be inserted into the openings 124 of the inside lock platform 10 and threadably received by the bosses 126 of the outside lock platform 14. The tightening of the screw fasteners 122 (e.g., with a screwdriver) draws the inside and outside lock platforms 10, 14 towards one another to create a solid door mount.

It should be observed that the lock platforms 10, 14 of the present invention each provide a solid mount to attach a door handle thereon. Moreover, since the key cylinder 36 is separately attached to the lock platform 14, the strength of its attachment to the lock platform 14 is not limited to the strength of the handle's attachment. Also, since the key cylinder 36 extends into the hole 20 of the door 18 it is somewhat protected from being tampered with.

While this invention has been illustrated and described in accordance with a preferred embodiment, it is recognized that variations and changes may be made therein without departing from the invention as set forth in the following claims.

Having described the invention, what is claimed is:

1. A lock platform for mounting and housing components of a handle and lock assembly on one side of a door having only one hole therein extending between planar surfaces on opposite sides thereof, said lock platform comprising:

a face plate having an outer periphery and an outer peripheral edge margin which extends from the outer periphery of the face plate generally perpendicularly away from the face plate in an inward direction whereby, when said outer peripheral margin is brought into a mounting position against a planar door surface, said face plate will lie in a plane parallel to, and spaced from, the surface thereby creating a space between the face plate and a door for accommodating components of the handle and lock assembly;

said face plate having a cylindrical pin extending therefrom in said inward direction for receiving thereover and rotatably supporting a disk component of a handle and lock assembly;

said face plate having a first opening therein for generally co-axial alignment with a hole in a door;

said face plate having a first hollow boss for receiving and securing one of a key cylinder and thumb turn component of a handle and lock assembly in a position so as to extend into a hole in a door, said first hollow boss surrounding said first opening and extending from said face plate in said inward direction;

an outwardly facing second hollow boss integrally formed with said face plate and extending therefrom in an opposite direction with respect to said peripheral edge margin, said second hollow boss defining a second opening for mounting a handle component of a handle and lock assembly on said face plate, said second hollow boss being located in a position off-set with respect to the first hollow boss;

a plurality of guide members defining a linear guide track for receiving a link component of a handle and lock assembly, said guide members projecting from an interior surface of said peripheral edge margin along a plane generally parallel to and offset from the plane of said face plate so as to define a guide track side facing said face plate; and, said face plate having mounting means, integrally formed thereon, for mounting the lock platform on a door, said mounting means being adapted to accommodate screws for drawing the face plate of the lock platform toward a face plate of a second lock platform positioned on an opposite side of a door as the lock platform is mounted on a side of the door, said lock platform comprising a single member for completely enclosing and providing the entire support for all components on one side of a door.

2. A lock platform as claimed in claim 1 wherein said first hollow boss, said second hollow boss and said pin have axes located on a common line.

3. A lock platform as claimed in claim 1 wherein said pin extends in said inward direction further than said peripheral margin edge.

4. A lock platform as claimed in claim 3 wherein said mounting means comprises a plurality of mounting bosses extending from said face plate in said inward direction by a distance further than said peripheral edge margin extends from said face plate.

5. A lock platform as claimed in claim 4 wherein said hollow mounting bosses, said first hollow boss and said pin are disposed within a circular area of said face plate having a diameter of less than two and one-eighth inches.

6. A combination comprising: first and second lock platforms as claimed in claim 1 wherein the mounting means on the first of the lock platforms comprises unthreaded hollow mounting bosses surrounding openings in the faceplate of the first lock platform and the mounting means on the second of the lock platforms comprises internally threaded bosses extending in the inward direction from the face plate of the second lock platform; and screws extending through said unthreaded hollow mounting bosses and into said internally threaded bosses.

* * * * *